US007065888B2

(12) United States Patent
Jaklitsch et al.

(10) Patent No.: US 7,065,888 B2
(45) Date of Patent: Jun. 27, 2006

(54) GYROSCOPIC SYSTEM FOR BORESIGHTING EQUIPMENT

(75) Inventors: James J Jaklitsch, Parkton, MD (US); Adam F. Ehart, Baltimore, MD (US); Doug A Jones, Aberdeen, MD (US); Jay M Markey, York, PA (US); Gary B Landsberg, Stewartstown, PA (US)

(73) Assignee: AAI Corporation, Hunt Valley, MD (US)

( * ) Notice: Subject to any disclaimer, the term of this patent is extended or adjusted under 35 U.S.C. 154(b) by 0 days.

(21) Appl. No.: 10/756,383

(22) Filed: Jan. 14, 2004

(65) Prior Publication Data

US 2005/0150121 A1 Jul. 14, 2005

(51) Int. Cl.
*G01C 15/00* (2006.01)
*G01C 19/38* (2006.01)

(52) U.S. Cl. ..... 33/286; 33/324; 33/318

(58) Field of Classification Search ..... 33/227–228, 33/263–264, 281–283, 285–286, 293, 318, 33/321, 324, 231
See application file for complete search history.

(56) References Cited

U.S. PATENT DOCUMENTS

| | | | | |
|---|---|---|---|---|
| 3,731,543 | A | 5/1973 | Gates | |
| 3,734,627 | A | 5/1973 | Edwards | |
| 3,739,646 | A | 6/1973 | O'Connor et al. | |
| 3,803,387 | A | 4/1974 | Lackowski | |
| 3,930,317 | A | 1/1976 | Johnston | |
| 3,955,468 | A | 5/1976 | Romilly et al. | |
| 4,012,989 | A | 3/1977 | Hunt et al. | |
| 4,038,527 | A | 7/1977 | Brodie et al. | |
| 4,134,681 | A | 1/1979 | Elmer | |
| 4,155,096 | A * | 5/1979 | Thomas et al. | 33/286 |
| 4,180,916 | A * | 1/1980 | Brook | 33/318 |
| 4,270,387 | A * | 6/1981 | Hoffman | 33/318 |
| 4,443,952 | A * | 4/1984 | Schulien et al. | 33/324 |
| 4,458,426 | A | 7/1984 | O'Connor et al. | |
| 4,472,978 | A * | 9/1984 | Levine et al. | 33/321 |
| 4,483,080 | A | 11/1984 | Knoll | |
| 4,649,274 | A | 3/1987 | Hartmann | |

(Continued)

FOREIGN PATENT DOCUMENTS

DE 42 34 026 C1 2/1994

(Continued)

*Primary Examiner*—Yaritza Guadalupe
(74) *Attorney, Agent, or Firm*—Venable, LLP; Jefferi A. Kaminski

(57) ABSTRACT

A gyroscopic system for translating parallel and non-parallel lines between a reference line and a device to be aligned with respect to the reference line is provided. The system includes a first inertial sensor configured to be substantially stationary, the first inertial sensor comprising a first three-axis gyroscopic sensor configured to produce an output signal and a reflector. A second inertial sensor is configured to be portable so as to be positionable adjacent to the first inertial sensor and comprises a gimbal restricted to two physical axes, a gimbal drive system, an electromagnetic energy beam generator, a second three-axis gyroscopic sensor configured to generate an output signal, and a collimator. The collimator is operable to determine an angle between a beam projected by the beam generator and a beam reflected from the reflector and to generate an output signal indicative of the determined angle. A control circuit is operable to process output signals generated by the collimator and the first and second three-axis gyroscopic sensors and determine relative orientations of the first and second inertial sensors with respect to each other.

13 Claims, 16 Drawing Sheets

U.S. PATENT DOCUMENTS

| | | | | | |
|---|---|---|---|---|---|
| 4,662,727 | A | | 5/1987 | Griffin et al. | |
| 4,738,531 | A | | 4/1988 | Lloyd et al. | |
| 4,756,088 | A | * | 7/1988 | Russell et al. | 33/312 |
| 4,762,411 | A | | 8/1988 | Pitalo et al. | |
| 4,844,383 | A | | 7/1989 | Hassenpflug | |
| 4,884,771 | A | | 12/1989 | Scheit et al. | |
| 4,896,032 | A | | 1/1990 | Ball et al. | |
| 4,919,528 | A | | 4/1990 | Pitalo et al. | |
| 5,088,818 | A | | 2/1992 | Nicholson et al. | |
| 5,408,751 | A | * | 4/1995 | Rodloff et al. | 33/318 |
| 5,438,404 | A | | 8/1995 | Hamilton et al. | |
| 5,619,323 | A | | 4/1997 | Hamilton et al. | |
| 5,672,872 | A | | 9/1997 | Wu et al. | |
| 5,778,543 | A | * | 7/1998 | Schneider et al. | 33/324 |
| 5,982,487 | A | * | 11/1999 | Schneider et al. | 33/324 |
| 6,061,611 | A | | 5/2000 | Whitmore et al. | |
| 6,257,059 | B1 | | 7/2001 | Weinberg et al. | |
| 6,396,235 | B1 | | 5/2002 | Ellington et al. | |
| 6,895,678 | B1 | * | 5/2005 | Ash et al. | 33/313 |
| 6,918,186 | B1 | * | 7/2005 | Ash et al. | 33/313 |
| 2005/0022402 | A1 | * | 2/2005 | Ash et al. | 33/321 |
| 2005/0126022 | A1 | * | 6/2005 | Hansberry et al. | 33/313 |

FOREIGN PATENT DOCUMENTS

| | | |
|---|---|---|
| EP | 0 557 591 | 9/1993 |
| RU | 2 006 794 | 1/1994 |
| SU | 1 578 462 | 7/1990 |

* cited by examiner

77

FLAT MIRROR

| MIRR 1 | MIRR 2 |
|---|---|
| 1 0 0<br>0 1 0<br>0 0 1 | N/A |

78

30 DEGREE BRM

| MIRR 1 | MIRR 2 | | |
|---|---|---|---|
| 1 0 0 | .866025 | 0 | .5 |
| 0 1 0 | 0 | 1 | 0 |
| 0 0 1 | -.5 | 0 | .866025 |

7.5 DEGREE BRM

90 DEGREE BRM

79

7.5 DEGREE BRM

| MIRR 1 | MIRR 2 | | |
|---|---|---|---|
| 1 0 0 | .991445 | 0 | .130526 |
| 0 1 0 | 0 | 1 | 0 |
| 0 0 1 | -.130526 | 0 | .991445 |

80

90 DEGREE BRM

| MIRR 1 | MIRR 2 |
|---|---|
| 1 0 0 | 0 -1 0 |
| 0 1 0 | 1 0 0 |
| 0 0 1 | 0 0 1 |

FIG. 12

GYROSCOPIC SYSTEM FOR BORESIGHTING EQUIPMENT

BACKGROUND OF THE INVENTION

1. Field of the Invention

The present invention relates generally to a system for aligning a device using the relative orientation of two structural lines, two virtual lines, or one structural and one virtual line. The invention further relates to a method and apparatus for optically acquiring a reference line and transferring parallel or non-parallel lines to determine the orientation of a device with respect to the reference.

2. Related Art

In order to control equipment such as sensors, guns, cameras and antennae mounted on vehicles such as aircraft or spacecraft, it is important to align the equipment boresights with respect to a reference axis on the vehicle. A number of methods exist for bringing weapon or navigational stations into alignment with the Armament Datum Line (ADL) on a variety of aircraft. The ADL defines the center line of the aircraft; however, it is more than simply a line because it also provides a roll reference. Although reference is made to an ADL for alignment applications involving spacecraft and aircraft, the method and apparatus is also useful in oil drilling, civil engineering, construction and medical applications, among others, which involve the alignment of any device with respect to a structural or virtual reference line.

One alignment method using the ADL of an aircraft, as shown in FIGS. 1A and 1B, involves attaching two brackets or adapters 220 and 222 to an aircraft 224 at two respective locations along the ADL 226. In addition, each station on the aircraft is fitted with its own adapter (not shown). A telescope 228 is then installed in the leading or forward end 222 bracket and is used to align with the rear or aft end bracket. With reference to FIG. 2, a target board 230 is set at a precise distance from the telescope 228. The target board is aligned so that a reticle 232 from the telescope falls upon an ADL fiducial 234 on the target board. The telescope is then moved from station adapter to station adapter while each station is boresighted with its own fiducial 236 on the target board. The use of the telescope and target board is limited to the transfer of parallel lines to align stations.

In the second alignment method, a "Christmas Tree" adapter 240 is attached to the aircraft (see FIG. 3) and is aligned to the ADL. Additional adapters (not shown) are also provided on each station and a telescope 242 is positioned at various points 244, 246 and 248 around the tree to align each station. In order to accommodate all the stations on an aircraft, this tree is necessarily large and onerous. Again, this method of alignment is limited to the transfer of parallel lines.

Both of these methods for boresight alignment have procedural and equipment aspects which seriously limit their ultimate accuracy. Some of these limitations include: the reliance on the proper alignment of the human eye with the optical system (parallax) for error readings; the correct positioning of the target board not only in standoff position but in pitch, yaw and roll positions; the use of a finite focal length reticle as a reference; the movement of the target board during alignment on the flightline due to wind and other factors; the warping or bending of the Christmas tree; and the movement of the aircraft itself, among other limitations.

Beyond accuracy, there are two other factors which make these methodologies undesirable: the size and weight of the auxiliary equipment, and the time needed to complete a station alignment. For example, the mounting stand 250 (FIG. 2) for a target board is 10 feet tall and weighs approximately 500 pounds. The alignment procedure for an aircraft using the target board requires the elevation of the front of the aircraft to relieve weight on the nose wheel using a 600 pound jack. The station adapters themselves typically weight 25 to 35 pounds and are awkward. The alignment procedure for the Apache helicopter typically involves removal of the windshield in order to install the "Christmas Tree" alignment adapter for a heads-up display.

The two boresighting methods discussed above employ optics to acquire the reference axis. A number of boresighting systems exist which employ gyroscopes to align a device with respect to another device. For example, U.S. Pat. No. 4,012,989 to Hunt et al. discloses an inertial sighting system for slewing the axis of a device which is mounted on an aircraft. The disclosed system comprises a pair of gyroscopes and a hand-held sighting device, which also comprises a pair of gyroscopes. Both sets of gyroscopes are initially caged to align the spin axis on each gyroscope on the aircraft mounted device with the spin axis of a corresponding one of the gyroscopes on the hand-held device to establish an arbitrary reference system between the two devices. Once the gyroscopes are uncaged on the sighting device, data is continuously fed from the hand-held device to generate orientation command signals for a gun.

U.S. Pat. No. 3,731,543 to Gates discloses a gyroscopic boresight alignment system comprising a master sensor unit having two gyroscopes which is mounted on an aircraft with respect to its armament data line. The system also comprises a remote sensor unit having a single gyroscope which is mounted on equipment. The misalignment of equipment is determined by comparing angular rates of the aircraft and equipment axes with respect to a parallel relationship with the ADL.

U.S. Pat. No. 3,930,317 to Johnston discloses an electronic azimuth transfer system comprising a navigator which is mounted on a vehicle. A remote sensor coupled to the navigator aligns itself with respect to North as does the navigator. The remote sensor is thereafter moved to a gun or other equipment to indicate equipment alignment with respect to North.

Prior gyroscopic alignment systems such as those discussed in the above-referenced patents are disadvantageous for several reasons. They are limited in operation to transfer only parallel lines with respect to a reference line, i.e., the ADL. Further, the systems in the Johnston and Gates patent do not provide for 3-axis detection. As a result, the accuracy of these systems is limited by the manner in which the gyroscopes on the master and slave inertial sensors are oriented with respect to each other. Specifically, if the hand held sensor is inadvertently rotated around the spin axis of the single gyro, the gyro senses no motion. Thus, the other two axes will no longer align with the axes of the double-gyro unit. This will cause a "cross coupling" error in the information produced by the device.

The disadvantages with the prior art described above were overcome with the system described in U.S. Pat. No. 5,438,404 entitled "Gyroscopic System for Boresighting Equipment by Optically Acquiring and Transferring Parallel and Nonparallel Lines", which is incorporated herein by reference. The system described in the '404 patent is an advanced technology boresighting system and generally outperforms other boresighting technology. However, the system described in the '404 patent does have some limitations. These limitations are associated with the fact that the system of the '404 patent relies on three axis inertial stabilization. This results in the boresight inertial unit of the '404 patent being physically large and heavy, making it difficult to use. The large weight and physical size is directly attributable to the fact that a housing for the unit must be physically large enough to fully enclose a gimbal with three degrees of freedom (yaw, pitch and roll). Another limitation is that precision gimbal components are very expensive. The need to have three degrees of freedom and the gimbal adds significant cost to the system.

Thus, there is a need for an advanced boresighting system that can reduce the cost and physical size of the boresight inertial unit, hereinafter referred to as a measurement unit, of a gyroscopic boresighting system.

BRIEF SUMMARY OF THE INVENTION

In an exemplary embodiment of the invention, a method for aligning a device is provided. The method comprises aligning a stationary inertial sensor with respect to a reference line. An electromagnetic beam is projected from a portable inertial sensor to a mirror coupled to the stationary inertial sensor and the angle of the reflected beam is detected. The relative position of the portable inertial sensor with respect to the stationary inertial sensor is determined using the detected angle and output data from a first three-axis gyroscopic sensor provided in the stationary inertial sensor and a second three-axis gyroscopic sensor provided in the portable inertial sensor. A two-axis gimbaled platform carrying circuitry for generating the electromagnetic beam is controlled to orient the platform.

In another embodiment of the invention, a method for reference sighting is provided. The method comprises determining a nominal mirror line in a base frame for each reference mirror. A first measurement vector is measured for the first reference mirror. An orientation of the first gyroscopic sensor and the second gyroscopic sensor is determined at the time of the measuring. The measurement vector is converted to quaternion form. An actual mirror line is computed with respect to the nominal mirror line. The orientation of the second gyroscopic sensor is virtually de-rolled. The optical reference line is caused to converge on the nominal mirror line.

In another embodiment of the invention, a method for determining a reference coordinate system is provided. The method comprises determining a unit vector in a base frame for each of first and second reflecting surfaces, wherein the unit vector is normal to the reflecting surface. A reference frame is determined based on the unit vectors. The reference frame is transformed to compute a station measurement in the base frame.

In another embodiment of the invention, a method for aligning a device with respect to a reference line by transferring parallel and non-parallel lines is provided. The method comprises aligning a stationary inertial sensor with respect to the reference line. An electromagnetic beam is projected from a portable inertial sensor to a mirror coupled to the stationary inertial sensor and detecting the angle of the reflected beam. The relative position of the portable inertial sensor is determined with respect to the stationary inertial sensor using the detected angle and output data from each of a pair of gyroscopes provided in the stationary and the portable inertial sensors. The portable inertial sensor is aligned with respect to the device. The position of the device with respect to the reference line is calculated using the detected angle and the output data.

In another embodiment of the invention, a gyroscopic system for translating parallel and non-parallel lines between a reference line and a device to be aligned with respect to the reference line is provided. The system includes a first inertial sensor configured to be substantially stationary, the first inertial sensor comprising a first three-axis gyroscopic sensor configured to produce an output signal and a reflector. A second inertial sensor is configured to be portable so as to be positionable adjacent to the first inertial sensor and comprises a gimbal restricted to two physical axes, a gimbal drive system, an electromagnetic energy beam generator, a second three-axis gyroscopic sensor configured to generate an output signal, and a collimator. The collimator is operable to determine an angle between a beam projected by the beam generator and a beam reflected from the reflector and to generate an output signal indicative of the determined angle. A control circuit is operable to process output signals generated by the collimator and the first and second three-axis gyroscopic sensors and determine relative orientations of the first and second inertial sensors with respect to each other.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

FIG. 12 illustrates exemplary directional cosign matrixes for different types of boresights reference mirrors;

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

While embodiments of the invention are designed to be used for alignment on any device needing information on the relative orientation of two structural lines, two virtual lines, or one structural and one virtual line, an exemplary embodiment of the invention is described in connection with aircraft weapon and sensor station alignment for illustrative purposes. The error in the boresight orientation of the stations on an aircraft is measured by finding the orientation of the station under test with respect to the aircraft center line or armament datum line (ADL). The ADL is a set of hard reference points installed into the airframe of each aircraft at the time of manufacture. The misalignment between the ADL and the various stations is established by optically acquiring the ADL of the subject aircraft and then translating this line over to the weapon or sensor stations. The individual station orientations are optically acquired, the offset from the desired orientation is determined, and the offset is adapted on an operator screen. The station can then be brought into alignment and re-checked with the advanced boresight electronics ("ABE") that are described in detail below. The correct alignment of the station does not need to be parallel to the ADL.

Figure 4:
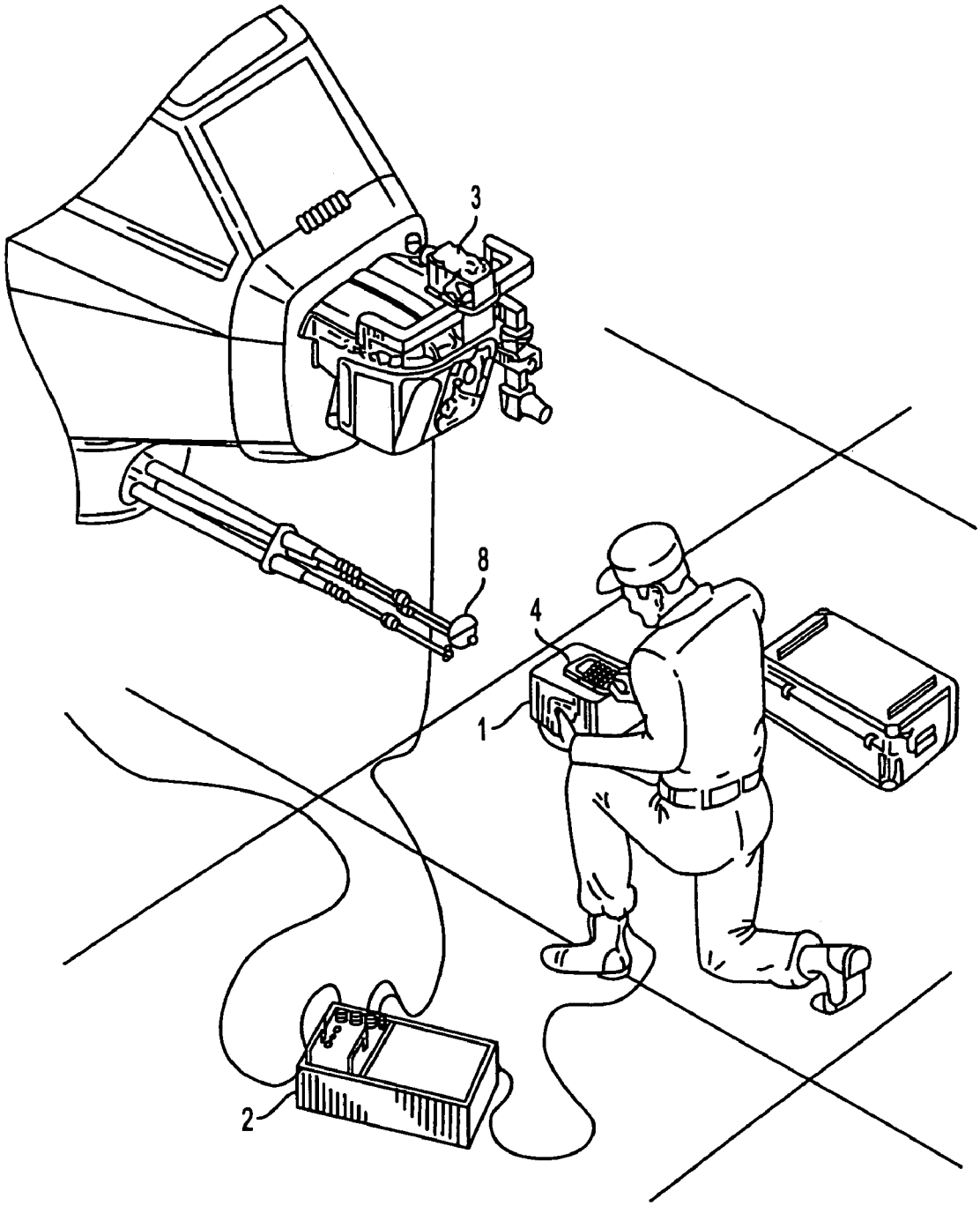
FIGS. 4 and 4A are block diagrams of major components of a system according to an embodiment of the present file.

The various components comprising a system according to an exemplary embodiment of the invention are shown in FIG. 4. Reference unit (RU) 3 houses three ring laser gyros (RLGs) and associated microcontroller electronics. The RU is provided with an interface plate (113). The interface plate 113 is a precision hard-point mount for interfacing to the aircraft master datum reference, typically referred to as the ADL. The RU incorporates a permanent mirror for acquisition of the RU orientation. The mirror has two perpendicular surfaces 114, 115, referred to herein as the 0 degree mirror and the 90 degree mirror. The mirrors (114 & 115) serve as precision optical references for ADL acquisition, which is the process by which the system establishes precision alignment between the measurement unit (MU) (1) and RU (3). ADL acquisition is described in more detail below. The RU 3 receives its power and control interface from a system controller through an interface cable. The RU 3 is attached to the aircraft ADL and determines ADL orientation.

The MU (1) is a portable, hand-held measurement device. It contains a two-axis stabilized gimbal 12, with a payload consisting of a Video Auto-Collimator (VAC) 14, a gimbal drive system, an integral three-axis gyroscopic sensor 13, and the associated gyro and microcontroller electronics. The VAC 14 contains measurement optics, and functions as a reticle projection/reticle imaging subsystem. The MU 1 receives its power and control interface from a system controller interface cable. Localized control of the gimbal structure, collimator, and self test is provided by an integral MU controller. The MU 1 is hand-held by the alignment technician 64, who carries the MU 1 from the ADL to the various stations.

The handheld data unit (HHDU) 4 provides the alignment technician with operator information and allows operator input to the ABE system. System commands are entered via the HHDU keypad. The HHDU 4 display provides indicators for the current operational mode, measurement results, and general system status.

The system controller 2 is the main command and control point for the ABE system. In addition to containing the system control processor and the interface to the MU 1, RU 3, and HHDU 4, it contains power supplies and the power distribution system. The system controller can accommodate personality modules.

A boresight reference mirror (BRM) 8 provides the reflecting surface needed to perform boresight measurements on various stations. Multiple versions allow for the acquisition of pitch, yaw, and roll within various sets of desired accuracies. A BRM is discussed below with reference to FIG. 8.

Figure 5:
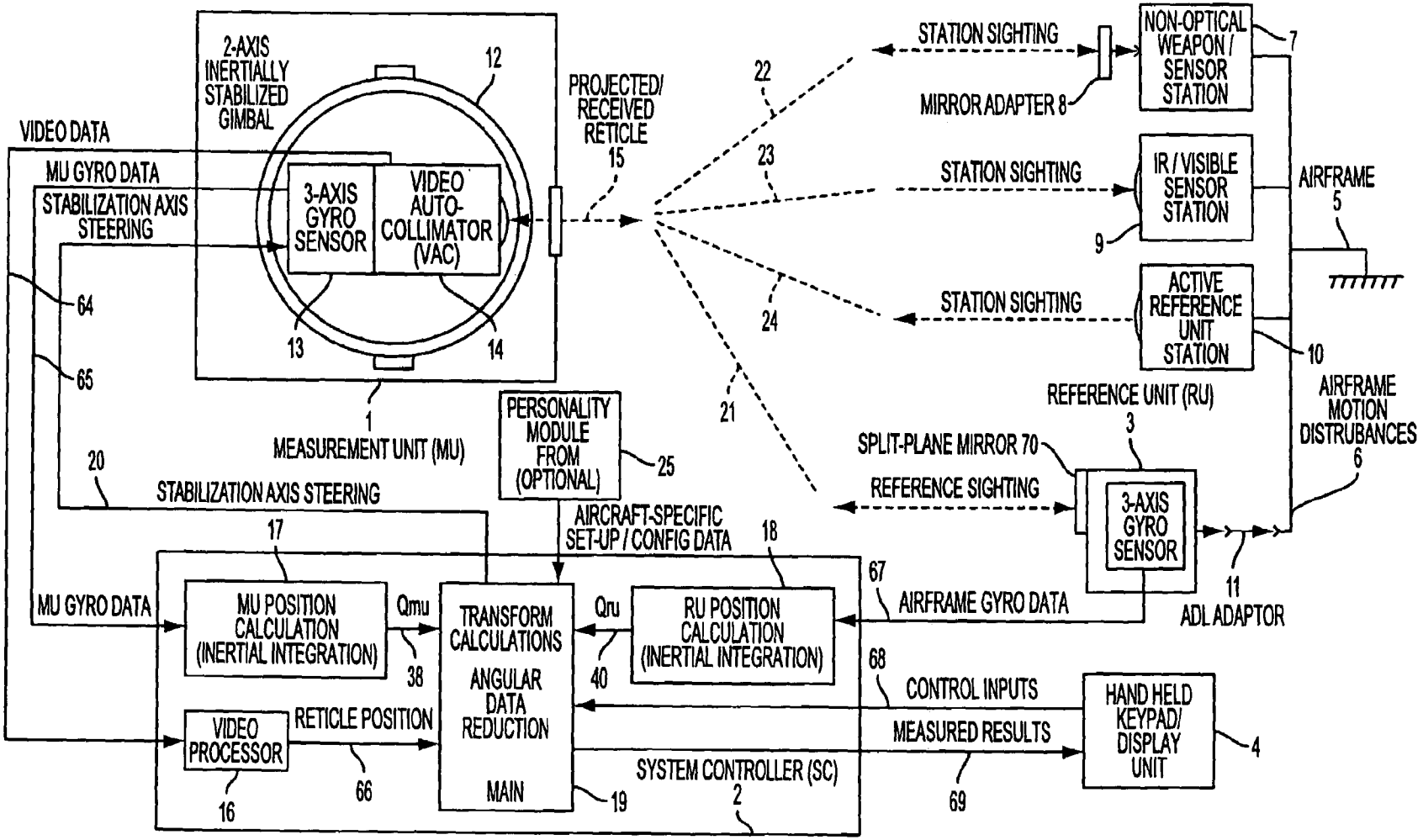
FIG. 5 is a schematic overview of a system according to an embodiment of the present invention.

FIG. 5 is a schematic diagram showing the ABE System interfaced to a schematic aircraft. The aircraft including a structural airframe (5), and various types of weapon/sensor stations (7, 9, 10). The airframe (5) is assumed to be a rigid body, and may be subjected to external motion disturbances (6) such as wind load, ship motion, or motion induced by people climbing on the aircraft.

In boresight applications, the RU (3) is interfaced to the airframe (5) by means of a precision ADL Adapter (11). The ADL Adapter (11) holds the RU (3), at a fixed orientation with respect to the airframe (5) coordinate system. The fixed orientation may be offset from the coordinate system. The RU (3) performs the function of tracking the airframe (5) as it moves through inertial space. It continuously reports gyroscopic data (67), representing aircraft motion, to the System Controller (2).

All measurements begin with a reference sighting (21), or "ADL Acquisition" measurement. This process effectively zeroes out any accumulated gyro drift by having the system measure its own zero reference. A more detailed example of an ADL acquisition method is described below with reference to FIG. 15. The zero reference is indicated by a split-plane mirror (70) that is integral with the RU (3). The split-plane mirror (70) (Shown schematically in FIG. 5) is physically implemented by the two mirrors shown in FIG. 2 as ADL reference mirror 1 (115) and ADL reference mirror 2 (114).

An alignment technician positions the MU 1 in the vicinity of the RU 3. Upon operator request via the HHDU 4, the MU controller commands the gimbal to conduct a spiral search pattern. This causes a collimated light beam 15 from the MU's VAC 14 to spiral until the beam reflected from the boresighting mirror 70 on the RU 3 is captured. The spiral scan may also be initiated by the alignment technician holding the MU 1 keying a trigger on the MU 1. The trigger is in parallel with the initiating key, for example the "Enter" key, on the HHDU 4. This allows the operator of the MU 1 to more directly control measurement functions, without requiring that a second operator enter data from the HHDU 4.

Once a reticle from the VAC 14 is identified during the spiral scan, i.e., the collimated light has been reflected from the mirror 70, and directed onto a CCD array or other sensor in the VAC 14, the orientation offset is calculated from the offset of the reflected reticle to a center pixel in the array.

The center pixel is determined during VAC assembly and provided as a parameter to the System Controller.

Once the ADL acquisition process is completed, the system is ready for station measurements. Different types of adapters and sensors can be mounted on the stations for taking measurements. Three different types of sensors are mounted on airframe 5; a non-optical weapon/sensor station 7, an IR/visible sensor station 9, and an active sensor station 10. Non-optical weapon/sensor stations (7) can be measured by fitting the station 7 with a BRM, and measuring the alignment of the mirror. Alignment of sensors that contain IR or Visible optics (IR/Visible Sensor Station) (9), can be measured by projecting a reference reticle beam (15) directly into the sensor optics, and using the sensor (9) to report any misalignment between the sensor zero reference and the projected reticle. Stations that produce active references (10), or in other words, generate a reference reticle, can be measured by directly imaging the reference reticle projected from station to structure 10 with the VAC optics (14), and computing a measurement in a manner similar to that used when measuring a reflected reticle.

In an example, a non-optical weapon station 7 is to be aligned. A boresight mirror 8 is mounted into an adapter coupled to the first station 7 to be aligned. If there is a desired offset in the orientation of this station with respect to the ADL, the pitch, yaw, and roll offsets are fed into the HHDU 4. For example, a weapon station can be mounted on the aircraft to have a line of sight that is elevated or perpendicular with respect to the ADL. This offset causes the MU 1 gimbal to rotate to that new orientation and this new orientation is then maintained. The offset with respect to the third axis is compensated for mathematically as described in more detail below. Thus, non-parallel nominal boresight lines (NBLs) can be transferred from the acquired ADL. Once the desired station orientation is set, the gimbal 12 is commanded to acquire the boresight mirror 8. The new orientation of the gimbal 12 is used as the center of the search spiral. Again, this capture can be performed on both on-axis and off-axis mirrors for roll orientation, as well as pitch and yaw. Other mirrors, however, which have only one mirror surface on stations such as guns for which roll orientation is irrelevant can be used. Upon acquisition, the actual orientation of the station is given with respect to the ADL or, as the case may be, the desired orientation. The result is displayed on an operator screen on the HHDU 4 in terms of offset angles of pitch, roll, and yaw.

If the station involves a virtual alignment, no capture of the VAC collimated light 15 is needed. Either the collimated light 15 from the VAC is used as a reference and is projected into the station, or the station under test can project its own reticle into the VAC such as the case for an active reference station 10 mentioned above. In the case of heads-up display alignment, a technician sits in the cockpit while another technician points the MU through the windscreen at him. The technician in the cockpit can actually see the reticle image of collimated light due to the focusing action of his eye. He then aligns the VAC reticle beam 15 with the reference reticle of the HUD. In the case of an infrared (IR) sensor, the MU 1 produces an IR beam parallel to the collimated light 15. This beam is directed into the sensor optics and the sensor is brought into alignment with the collimated light 15.

Figure 6A:
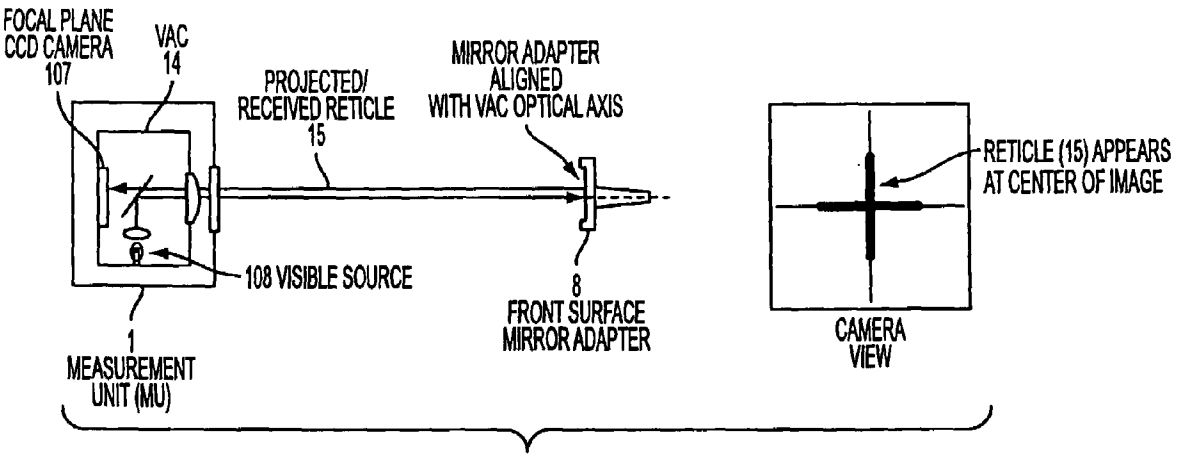
FIGS. 6A and 6B illustrate a method of aligning the mirror with the autocollimator.
Figure 6B:
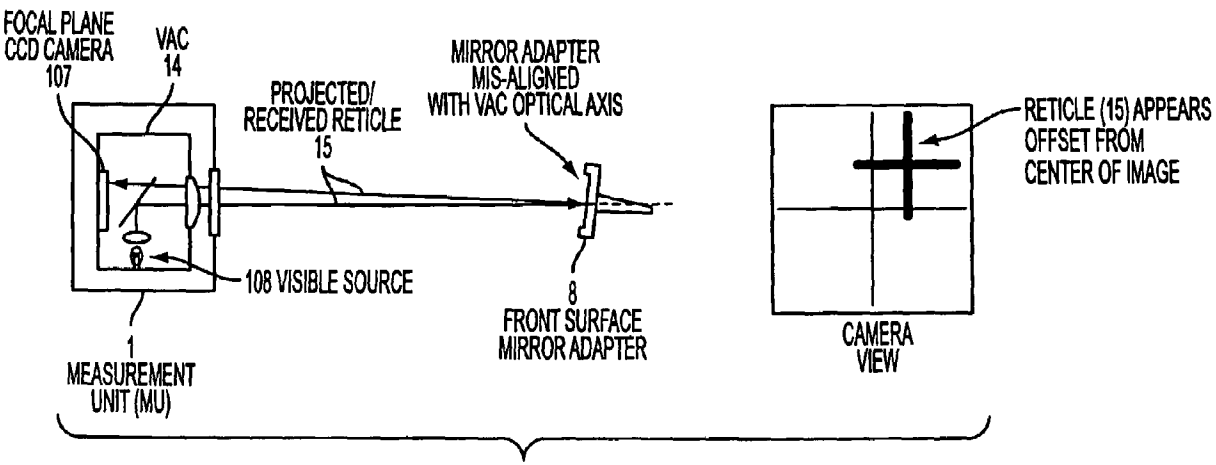

FIG. 6 provides additional explanatory detail regarding use of the VAC (14) to measure the orientation of a mirror (8). In FIG. 6(*a*), the mirror (8) is directly aligned with the optical axis of the VAC (14). Internal to the VAC (14), a visible source (108) produces a visible reticle (15) that is projected along the optical axis. The projected reticle (15) strikes the mirror (8), reflects directly back on itself, and enters the VAC (14) directly aligned with the optical axis. The reticle image that forms on the focal-plane CCD video camera (107) is centered, as shown at the right side of FIG. 6(*a*). This indicates that the mirror 8 is aligned with the VAC 14 optical axis.

In FIG. 6(*b*), the mirror (8) is misaligned with the optical axis of the VAC (14). The projected reticle (15) strikes the mirror (8), reflects at an angle equal to twice the mirror misalignment, and enters the VAC (14) misaligned with the optical axis. The reticle image that forms on the focal-plane CCD video camera (107) is offset, as shown at the right side of FIG. 6(*b*), by an amount that is proportional to the angular misalignment of mirror (8) with respect to the VAC optical axis. By detecting the amount of reticle misalignment within the image frame, it is possible to calculate the angular alignment of the mirror (8) from the VAC optical axis, in yaw and pitch. This process can also be used to determine the offset during the ADL acquisition process described above.

As mentioned above, the VAC (14) contains measurement optics, and functions as a reticle projection/ reticle imaging subsystem. It is capable of projecting either an IR or visible reticle (15) into the optics of IR or visible sensor stations (7, 9). It is also capable of optically measuring the angular difference between the VAC (14) optical axis and the axis of an externally generated reticle by imaging the external reticle with a focal-plane video camera. It is also capable of optically measuring the angular difference between the VAC (14) optical axis and the normal axis of a front-surface mirror 8, by reflecting a VAC-generated reticle (15) off the mirror (8), and imaging the reflected reticle with a focal-plane video camera.

Referring again to FIG. 5, the MU three-axis gyroscopic sensor (13) performs the dual functions of inertially stabilizing the VAC (14), and measuring the angular orientation of the VAC optical axis. It continuously reports gyroscopic data (65), representing VAC orientation, to the system controller (2). The VAC optical axis may be electronically steered and stabilized, in two axes, along any aircraft coordinate axis.

As shown in FIG. 5, the video data (64) from the focal plane video camera 107 internal to the VAC (14), is transmitted to a video processor (16) in, the system controller (2). The video processor (16) detects reticle images within the video data and uses reticle position within the image frame to determine the angular orientation of received reticles (Reflected MU reticle or externally generated reticle) with respect to the VAC Optical Axis. This data is provided to the processor 19 in the system controller 2 as reticle position (66).

The system controller (2) also receives gyroscopic data from both the RU (3) and MU (1). This data is integrated to determine the position of both the aircraft (5) and the VAC (14) optical axis. The airframe gyroscopic data (67) from the RU (3) is integrated by a RU position calculator (18) to form a three-dimensional angular transform, Qru (40), that describes the orientation of the RU gyro sensor (3), with respect to its original position. In a similar manner, the MU gyroscopic data (65) is integrated by an MU gyro position calculator (17) in the system controller 2 to form a three-dimensional angular transform, Qmu (38), that describes the orientation of the MU gyro sensor (13), with respect to its original position.

The "Q" designation used with Qru (40) and Qmu (38) denotes that these transforms are computed as Quaternions, which are known mathematical constructs for representing 3-D angular motion. There are two other known mathematical constructs for representing 3-D angular motion (transforms), including direction cosine matrices (DCMs) and ordered eulerian angles {yaw, pitch, roll}. The three known methods for representing 3-D angular transforms each have computational advantages and disadvantages, but can generally be used interchangeably.

Figure 10:
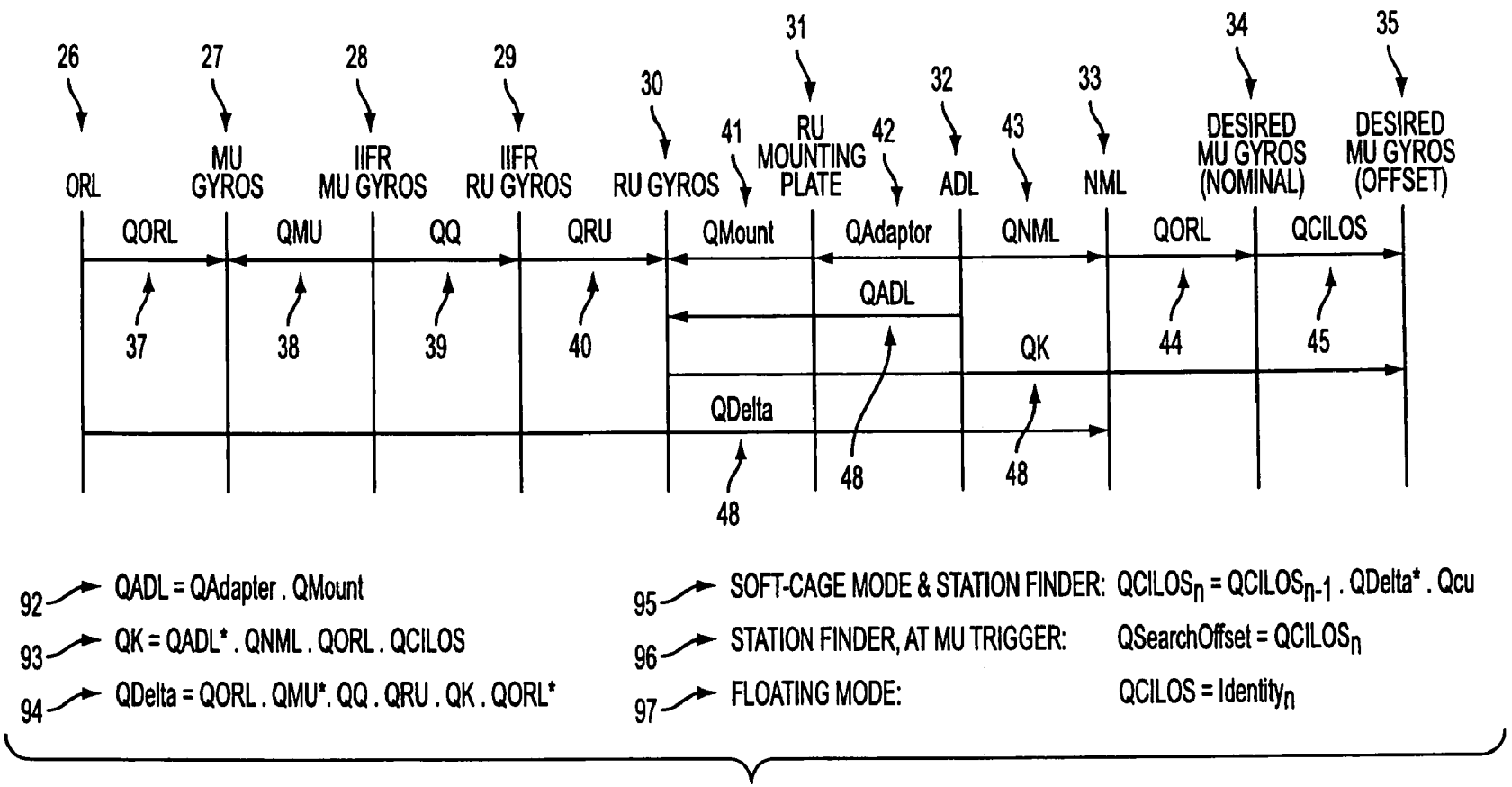
FIG. 10 illustrates platform stabilization transforms according to an exemplary embodiment of the present invention.

As shown in FIG. 5, the main processor (19) within the SC (2) control inputs 68 from HHDU, Qmu, Qru, and reticle position. The main processor 19 uses a series of transform computations to provide a stabilization and axis control signal (20) to the gimbal (12) in the MU 1 and to compute measured results 69 that are provided to an operator via HHDU 4. The relative 3-D orientation between Qru (40) and Qmu (38) is continuously compared to a desired (commanded) orientation, and steering commands (20) are output to the gimbal (12) in a closed-loop servo arrangement. (Detail is shown in FIG. 10.) The steering commands 20 continuously update the gimbal stabilization axis to hold the gimbal 12 in a fixed orientation with respect to the aircraft (5). As the aircraft (5) moves, the gimbal (12) tracks it, so that the relative orientation between the aircraft 5 and the VAC (14) optical axis is fixed. A virtual link is created between the aircraft 5 and the optics in the MU 1. A more detailed description of process for stabilizing the gimbal is given below.

The differential stabilization technique described above allows the boresight system to reject motion of the aircraft. It permits accurate measurements in the presence of a wide range of motion disturbances, including Earth's rotation, vibration, wind-load, motion induced by people climbing on the airframe, and the deck motion found on-board ships at sea. In prior-art implementations, the differential stabilization was implemented using a three-axis gimbal in the MU 1 to provide the necessary three degrees of freedom for stabilizing the VAC optics, and decoupling the optics angular orientation (controlled by the main processor (19)) from the angular orientation of the MU 1 (controlled by the operator). The improved implementation disclosed herein restricts the gimbal degrees of freedom to only two axes (yaw and pitch), in order to save cost and reduce size and weight of the MU (1). The projected reticle, (15) is therefore only de-coupled from the case of the MU and stabilized in yaw and pitch, and is constrained to assume whatever uncontrolled roll attitude is imparted to the case of the MU 1 case by the operator. The reticle is allowed to roll about the VAC optical axis, but the effect of this uncontrolled roll motion is compensated mathematically.

The ABE system computes measurements by combining the reticle position data (66) from the video processor, the Qru (40) and Qmu (38) transforms, and additional transforms that relate known angular relationships throughout the system. These measured results (69) are output to the HHDU for display to the operator. The HHDU (4) keypad also allows the operator to provide control inputs (68) to configure and operate the system. The process for compensating for the two-axis gimbal and for determining the measurements is described in more detail below with reference to FIGS. 7–15.

Figure 7:
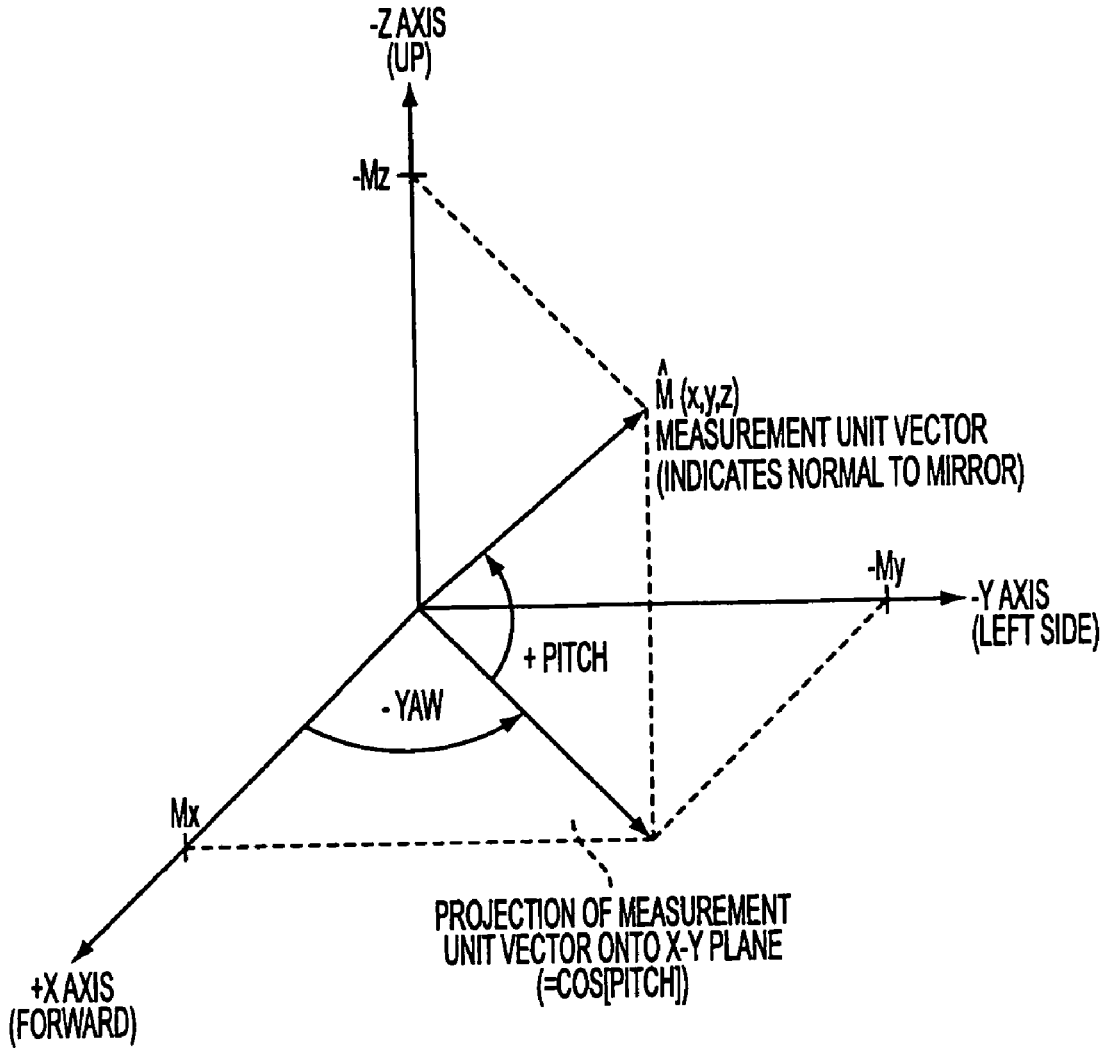
FIG. 7 illustrates an example of an ABE coordinate system.

FIG. 7 illustrates the ABE coordinate system, and illustrates rectangular coordinate {X, Y, Z} and Eulerean angle {Yaw, Pitch} representations of a unit magnitude vector in 3-D space. This information is provided for reference purposes. All measurements are made as 3-D unit vectors, and pairs of vectors are combined to defined 3-D reference frames.

Figure 4A:
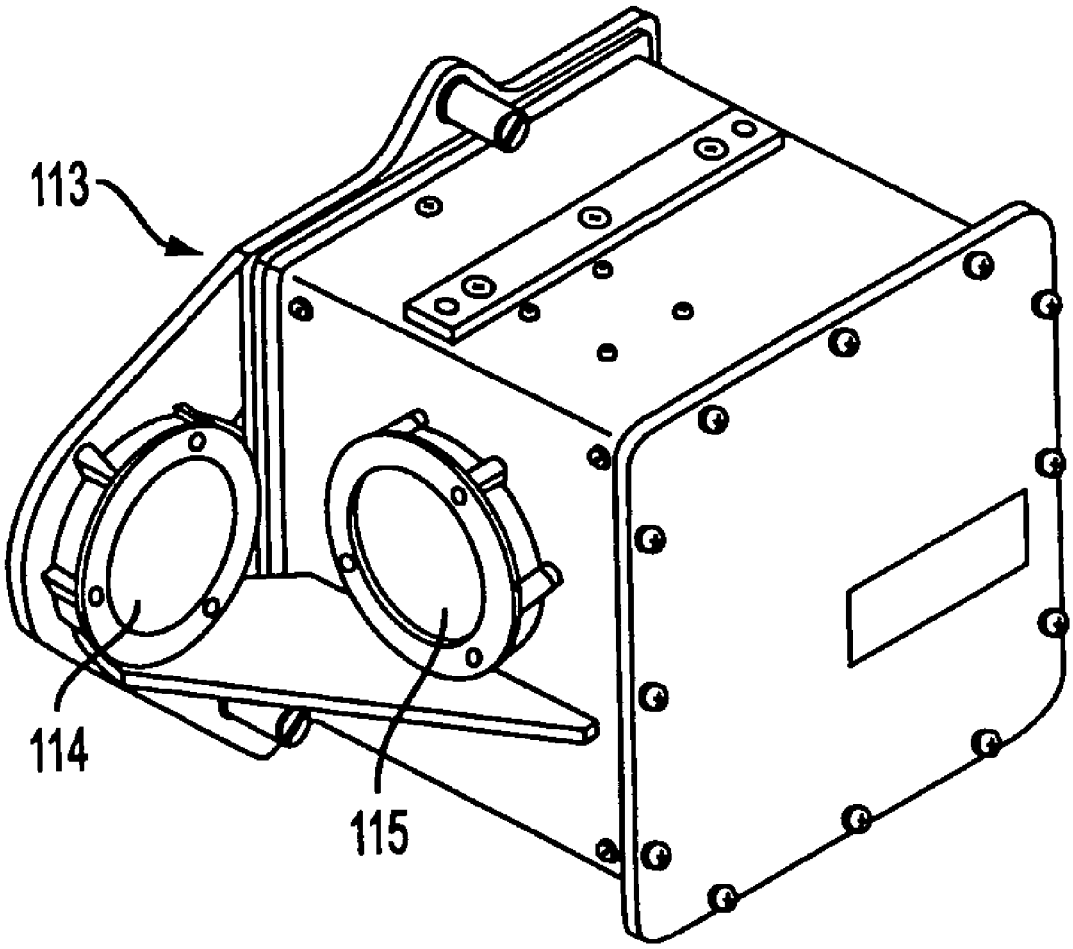
Figure 8:
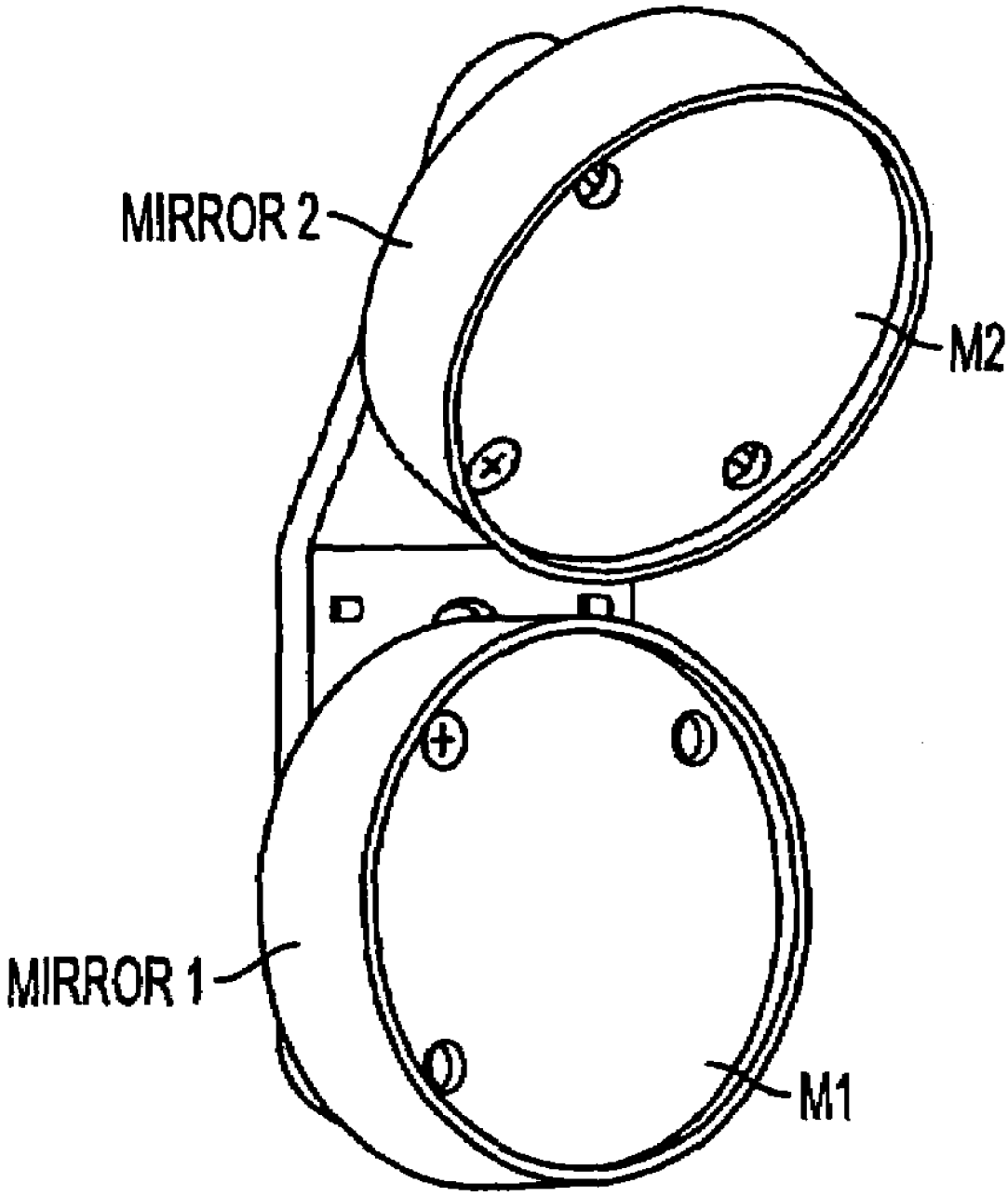
FIG. 8 illustrates a boresight reference mirror according to an exemplary embodiment of the present invention.

FIG. 8 illustrates a typical boresight reference mirror (BRM) 8. This particular example is a 30° Vertical BRM, meaning that Mirror 2 is displaced from Mirror 1 by 30° in the vertical plane. Other standard types of BRMs include: 30° Inverted Vertical, 30° Horizontal Left, 30° Horizontal Right, 7.5° Vertical, 7.5° Inverted Vertical, 7.5° Horizontal Left, 7.5° Horizontal Right, 90° Horizontal Left, 90° Horizontal Right, and Flat. Note that the RU reference mirrors (114 & 115) shown in FIG. 4A are effectively a 90° Horizontal Left BRM, attached to the RU 3. As shown in FIG. 8, each BRM mirror defines a vector M1, M2 normal to the mirror face. A flat BRM includes a single mirror, and defines only one vector. All other BRM types have two mirrors, and the two mirror vectors define a 3-D coordinate frame. By convention, the flat mirror is designated as Mirror 1, and the corresponding mirror vector as M1. The offset mirror is designated as Mirror 2, and the corresponding mirror vector is M2.

Figure 9A:
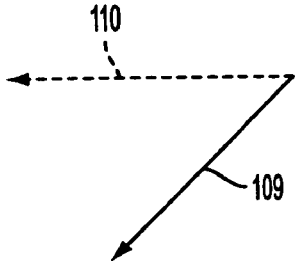
FIGS. 9A–9C illustrate examples of a mirror coordinate frame.
Figure 9B:
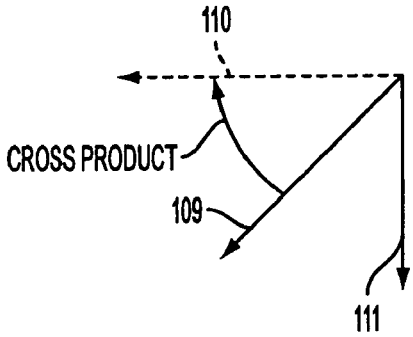
Figure 9C:
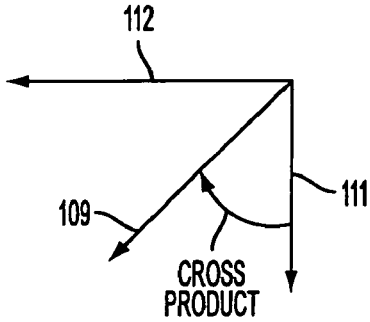

FIG. 9 illustrates the process by which a local 3-D reference frame (BRM Frame) is computed from the two vectors of a BRM. The BRM Frame is represented by a 3×3 Direction Cosine Matrix (DCM), that expresses the {X', Y', and Z'} axes of the BRM Frame in terms of the {X, Y, Z} coordinates of the base frame in which vectors M1 and M2 are measured. Row 1 of the DCM represents the X'-axis in the {X, Y, Z} coordinates of the base frame. Similarly, Row 2 of the DCM represents the Y' coordinates, and Row 3 of the DCM represents the Z' coordinates.

As shown in FIG. 9(*a*), the X'-axis is taken as the M1 vector (109). The M2 Vector (110) is nominally oriented towards the Y'-axis, but the amount of rotation is unknown and could be any angle. In FIG. 9(*b*), the Z'-axis (111) is computed as the normalized vector cross-product (Mutual Orthogonal) of M1 (109) into M2 (110). FIG. 9(*c*) completes the process by computing the Y'-axis (112) as the normalized vector cross-product (Mutual Orthogonal) of the Z'-axis (111) into the X'-axis (109). Once the X', Y' and Z' axes are known, they may be formed into a DCM that describes the BRM Frame in terms of the coordinates of the base frame. The DCM may be converted to either Quaternion or Eulerian representations, as required, using known mathematical processes.

Gimbal Steering & Stabilization Processing

FIG. 10 shows the processing detail associated with steering the gimbal stabilization axis. As mentioned above, the system controller 2 includes a processor 19 that generates a stabilization and axis control signal 20 for the gimbal 12. In FIG. 10, each vertical line represents a localized frame of reference (3 D orientation), and the arrows represent transforms between reference frames. The direction of the arrows is important. The RU interface plate 113 (FIG. 2) is the physical interface between the RU (3) and the ADL Adapter (11). This interface is reference frame 31. The ADL (32) represents the airframe (5) coordinate system, which is the frame in which all measurements are ultimately referenced. There may be an angular offset between the ADL (32) and the RU Mounting Plate (31), for example if the RU (3) is rotated with respect to the aircraft (5). This potential rotation is represented by QAdapter (42). QMount (41) represents the orientation of the RU Gyros (30) with respect to the RU Mounting Plate (31). QADL (46) represents the RU Gyro frame (30) in ADL (32) coordinates, and is computed as the combination of QMount (41) and Qadapter (42), as noted in equation (92).

QMU (38) and QRU (40) are quaternion transforms that represent the position of the MU Gyros (27) and the RU Gyros (30), respectively, in relation to their starting positions. The starting positions are referred to as the Integration Inertial Frame Reference (IIFR). The IIFR for the RU Gyros (29) and the IIFR for the MU Gyros (28) are different, and are separated by the transform QQ (39). QQ is set to an initial estimate during system power-up, and is periodically fine-tuned by the ADL acquisition process, described in connection with FIG. 15, to affect a precision alignment between the RU Gyros (30) and the MU Gyros (27).

The Optical Reference Line, or ORL (26) is the optical axis of the VAC (14). The QORL transform (37) represents the 3-D relationship between the ORL (26) and the MU Gyros (27).

The Nominal Mirror Line (NML) (33) is a frame that represents the expected position of the target mirror. The QNML transform (43) describes the 3-D orientation of the NML (33) with respect to the ADL (32). Although a mirror position technically defines only a single vector, the NML (33) should be a 3 D Frame in order to allow subsequent transform processing of other frames of interest. The QNML transform (43) is therefore computed such that the X'-axis of the NML frame (33) is the expected position of the mirror vector, and the NML frame is at a zero-roll attitude with respect to the ADL (32).

The output of the platform stabilization computation is the Qdelta transform (48). Qdelta describes the position of the NML (33) with respect to the ORL (26). In other words, driving this transform to identity forces the VAC optical axis (ORL 26) to converge on the expected position of the target mirror (NML 33). The stabilization and control signal 20 axis steering (FIG. 5) is implemented by converting the Qdelta (48) quaternion transform to a (Yaw, Pitch, Roll) Eulerian angle representation, then using the Yaw and Pitch terms to drive the gimbal (12) servo motors, thereby physically driving the VAC (14) optical axis to the expected mirror coordinates. The roll term cannot be removed, because the gimbal (12) is limited to only two degrees of freedom in order to reduce the size and weight of the MU (1). The un-desired roll is thus an error term that should be compensated mathematically as described below in several critical system processes in order to allow accurate measurements.

The yaw and pitch gimbal drive signals are also combined with other offset terms to incrementally deviate the VAC (14) optical axis from the stabilization axis, in order to implement functions such as optical search scans and optical tracking functions. These offsets are implemented as transient deviations from the stabilization axis, and do not affect the basic transform processing described above.

The equation (94) for computing Qdelta (48), from a cascade of component transforms, includes a term QK (47). QK is a partial product transform, relating an offset in desired MU gyro position (35) from the RU gyro position (30). QK (47) is computed from equation (93), which includes a term QCILOS (45). CILOS is an acronym referring to Case Indicated Line Of Sight, and QCILOS (45) is a transform that describes an offset in the desired position of the MU Gyros (35) with respect to the nominal desired position for the gyros (34). The offset can occur because, in certain gimbal control modes, such as station finder and soft cage described below, the gimbal (12) is slaved to the MU (1) case, and is driven away from its nominal desired orientation. The desired position for the MU Gyros (34) is offset from the NML (33) by QORL (44). When the gimbal (12) is allowed to float (normal measurement mode), QCILOS (45) is set to identity (Equation (97)).

In addition to the normal measurement mode, there are two other gimbal control modes, soft cage and station finder. Soft cage is a mode that drives gimbal (12) to follow the MU (1) case orientation, thereby allowing the MU operator carry the MU 1 around the aircraft 5, turning as required, without inadvertently driving the gimbal (12) into its stops. Soft cage is implemented by allowing the QCILOS (45) to integrate per equation (95). An existing value for QCILOS is updated by rotating the existing QCILOS transform by an incremental amount. The QCU term in equation (95) is a CILOS update transform, derived from the gimbal resolvers (Angular position sensors) by converting the yaw, pitch resolver readings to Quaternion form, assuming zero roll. This rotates the existing value for the QCILOS (45) transform by an incremental amount, as indicated by non-zero angles on the gimbal resolvers, thus driving the gimbal towards its center position within the MU case (zero resolver position). The Qdelta* term within equation (95) is a mathematical compensation for the un-desired roll orientation of the gimbal (* denotes the mathematical conjugate of the quaternion), and effectively allows the QCU update transform to be applied in the rolled frame.

Figure 11:
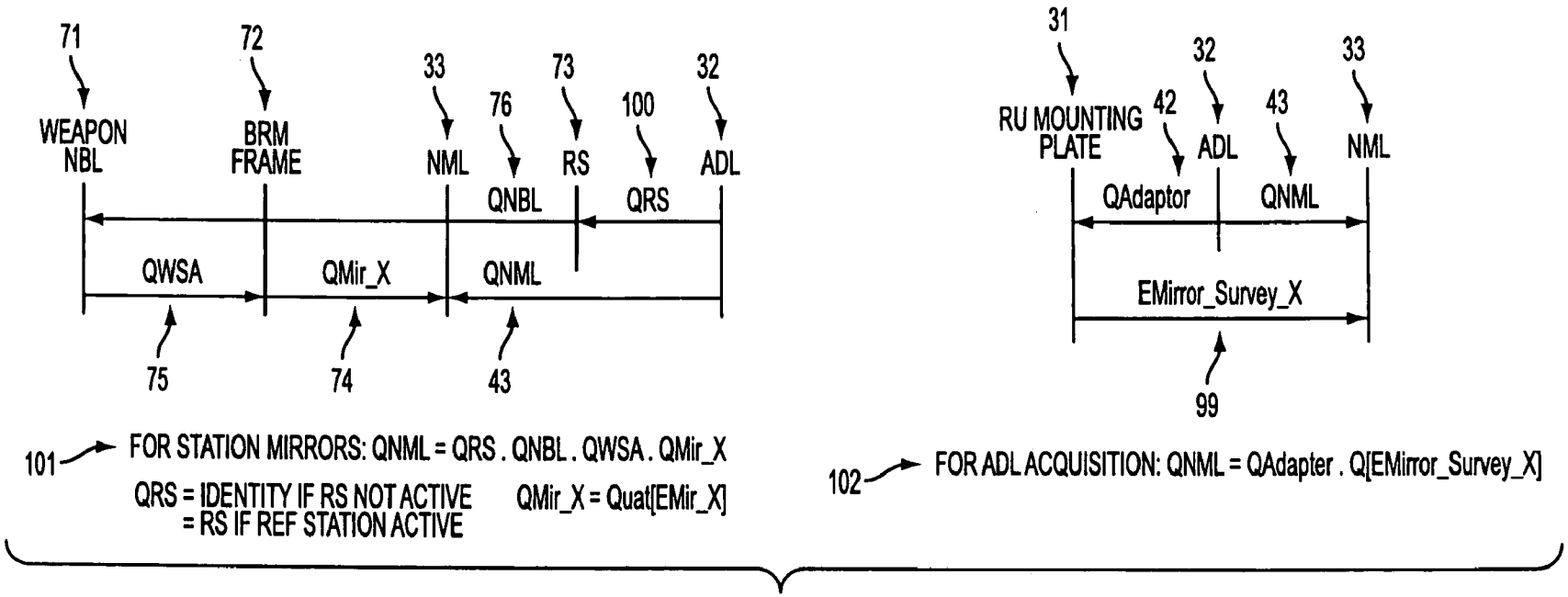
FIG. 11 illustrates transforms for nominal mirror line calculation according to an exemplary embodiment of the present invention.

FIG. 11 shows the relationships for computing QNML (43) for each of the various mirror types used with the ABE system. The left side of FIG. 11 shows the relationships for mirrors attached to measurement stations. As noted in the FIG. 10, the ADL (32) represents the reference frame for aircraft coordinates. QRS (100) is a quaternion transform that describes the orientation of a designated reference station (RS) (73) with respect to the ADL (32). This implementation allows any station to be measured, in ADL (32) coordinates, then designated as the reference (73) for all other station measurements. If no RS is designated, QRS (100) is set to identity, and the RS (73) is the ADL (32).

QNBL (76) is a transform that describes the Nominal Boresight Line (NBL) (71) coordinates in terms of the RS (73). The NBL (71) is the nominal or expected position of the station to be measured, and is specified as a set-up parameter for each station. QWSA (75) is a transform that specifies the orientation of the BRM Frame (72) with respect to the weapon station coordinate frame, which is initially assumed to be the NBL (71). QWSA (75) refers to Weapon Station Adapter, and is a term that allows the adapter BRM to be rotated with respect to weapon coordinates. QMir_X (74) is a transform that specifies the orientation of BRM 8 Mirror 1 and Mirror 2 (FIG. 8), respectively, with respect to the BRM Frame (72). The QNML (43) transform is computed, for each mirror, using equation (101).

The QMirr_X (74) term in FIG. 11 is the quaternion representation of the Direction Cosine Matrix (DCM) data shown in FIG. 12 (Emir_X). FIG. 12 lists the DCM data that defines the orientation of the two BRM mirrors for each type of standard BRM: Flat Mirror (77), 30° Vertical BRM (78), 7.5° Vertical BRM (79), 90° Horizontal Left BRM (80), 7.5° Inverted BRM (81), 30° Inverted BRM (82), 90°, Horizontal Right BRM (83), 30° Horizontal Left BRM (84), 30° Horizontal Right BRM (85), 7.5° Horizontal Left BRM (86), 7.5° Horizontal Right BRM (87).

Figure 1A:
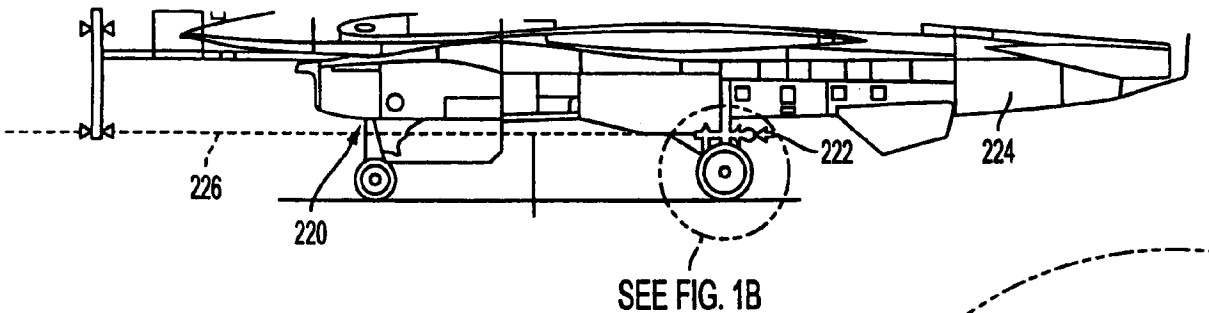
FIG. 1A PRIOR ART
FIGS. 1A, 1B and 2 depict a prior art aircraft equipment alignment system employing a target board.
Figure 1B:
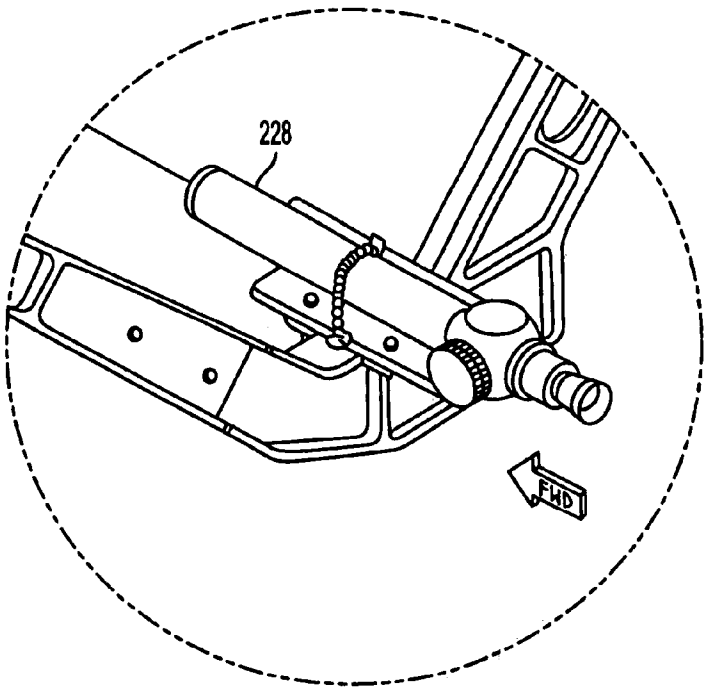
FIG. 1B PRIOR ART
Figure 2:
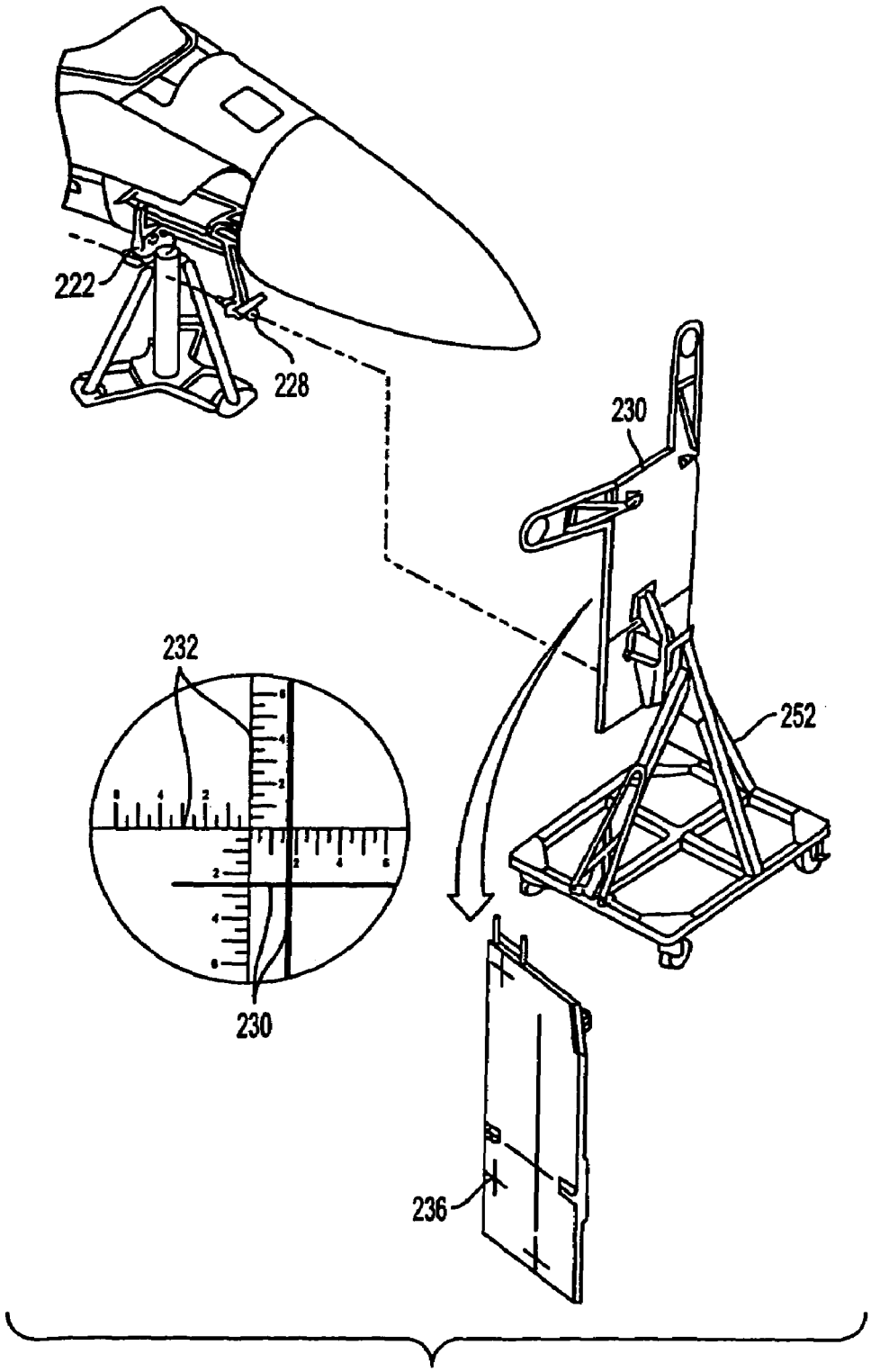
FIG. 2 PRIOR ART
Figure 3:
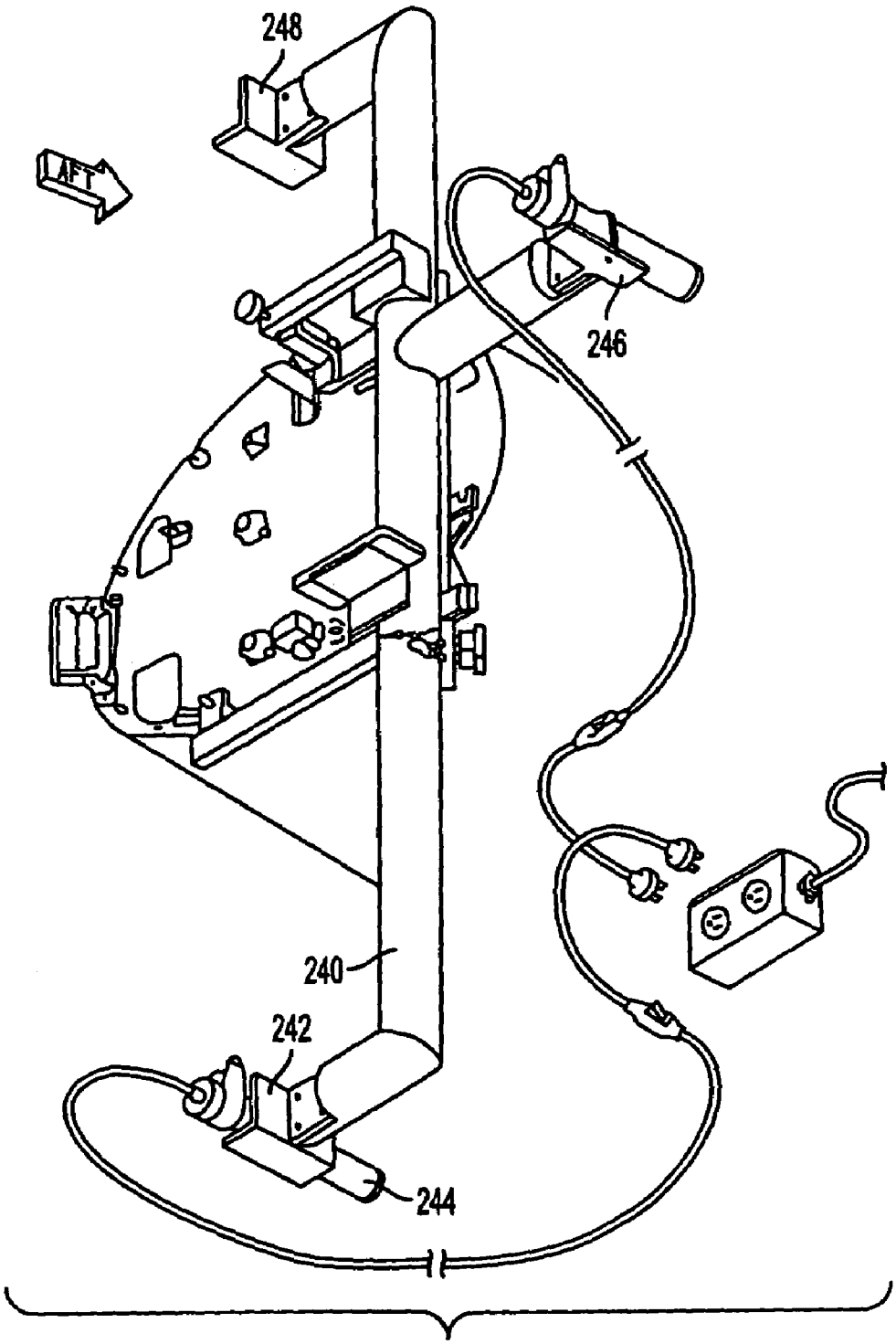
FIG. 3 PRIOR ART
FIG. 3 depicts a prior art aircraft equipment alignment apparatus for mounting a telescope in various positions.

The right side of FIG. 11 shows the QNML (43) relationships for the reference mirrors on the RU 3 (Ref: FIGS. 2, 114 & 115). The term labeled Emirror_Survey_,X (99) is a DCM, stored in the RU (3) as digital alignment data. This term specifies the orientation of each of the reference mirrors (FIGS. 2, 114 & 115), with respect to the RU interface plate 113, reference frame (31). As mentioned above, the RU interface plate 113 is the physical interface between the RU (3) and the ADL Adapter (11). The ADL (32) represents the airframe (5) coordinate system, which is the frame in which all measurements are ultimately referenced. There may be an angular offset between the ADL (32) and the RU interface plate if the RU (3) is rotated with respect to the aircraft (5). This potential rotation is represented by QAdapter (42). QNML (43) is the transform representing the Nominal Mirror Line (NML) (33) orientation in the ADL Frame (32). This term is computed using equation (102).

Computing Mirror Vectors

Figure 13:
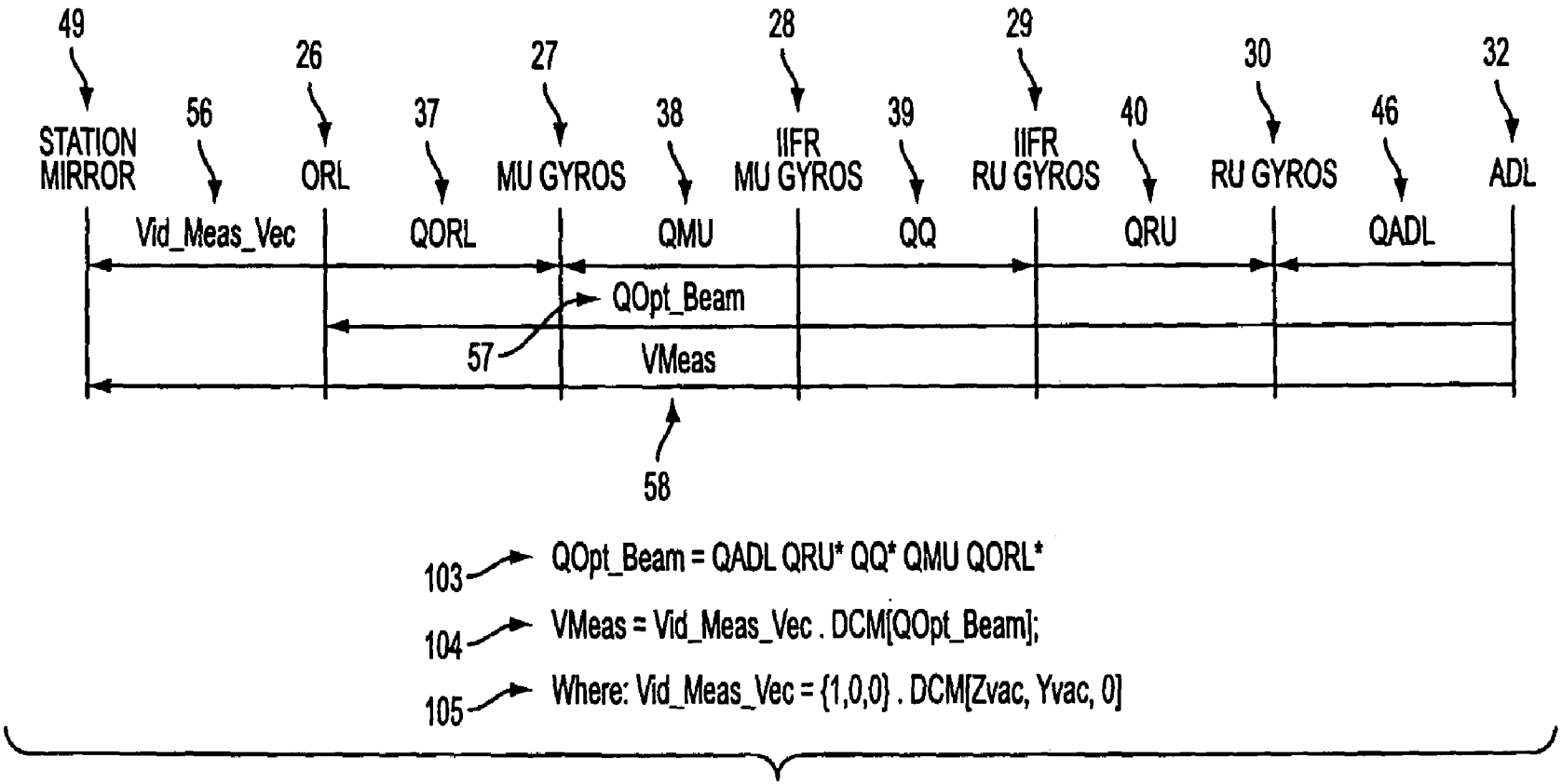
FIG. 13 illustrates exemplary mirror measurement vector transforms according to an exemplary embodiment of the present invention.

FIG. 13 shows the transform processing associated with computing mirror vectors. This is the lowest level of measurement processing, and is common to all mirror measurements in all system modes. The hierarchy of measurement processing in the ABE is summarized as follows:

a. Mirror Measurement: Mirrors are measured as {X,Y,Z} unit vectors in the ADL Frame, where the vector is normal (perpendicular) to the face of the mirror, and is oriented so that the vector points away from the mirrored surface (Per FIG. 13).

b. Computation of BRM Frames: Two mirror vectors are combined to compute the mirror frame (Per FIG. 9), then rotated (in accordance with the BRM Type) to compute the BRM Frame (72). (Not applicable to Flat Mirror Mode)

c. Computation of Weapon Station Frame: The computed BRM Frame (72) is transformed, in accordance with the specified QWSA transform (75), to compute the weapon station measurement in the ADL Frame. (Not applicable to Flat Mirror Mode).

Format of Results: As a final step in the measurement process, the measurement is converted to a desired display format. This is typically a {Yaw, Pitch, Roll} ordered Eulerian angle representation. Other formats can be specified by means of a Personality Module.

As shown in FIG. 13, the cascaded series of transforms from the ADL (32) to the ORL (26) are the same as were previously discussed in FIG. 10. This series cascade can be expressed as a single transform QOpt_Beam (57), that describes the orientation of VAC Optical Reference Line (ORL) (26) in ADL Coordinates. The combined transform, QOpt_Beam (57), is computed in accordance with Equation (103).

The alignment of the Station Mirror (49) with respect to the ORL (26) is measured optically, and computed as the Video Measurement Vector (Vid_Meas_Vec) (56) using equation (105). In equation (105), Zvac is the Yaw deviation measured by the Video Processor (16), and Yvac is the Pitch deviation. These Eulerian angles are converted to DCM form, and the top row (X-axis) of the DCM s taken as the Video Measurement Vector (56). The measurement vector of the Station Mirror (49) in ADL (32) coordinates, V Meas (58), is computed by multiplying a DCM representation of the optical beam position by the Video Measurement Vector, as shown in Equation (104).

Station Finder Operation

Figure 14:
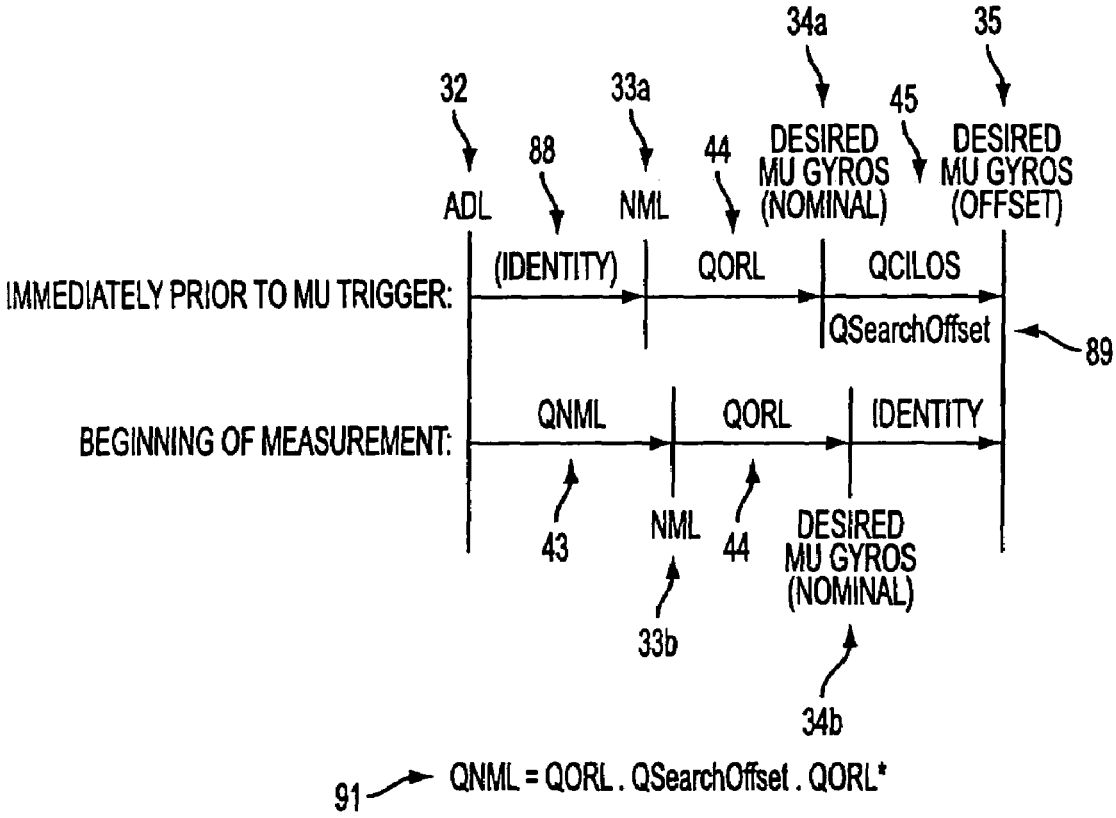
FIG. 14 illustrates exemplary station finder computations according to an exemplary embodiment of the present invention.

FIG. 14 shows the transform structure and processing used to implement the station finder mode. Station finder is a utility that allows the operator to find mirrors that are so far out of alignment (More than 2.5°) that they are not captured by the normal optical search scan. Station finder operates by soft caging the gimbal (12), that is, slaving the gimbal to follow the MU case orientation. The MU operator then aims the MU 1 at the misaligned mirror, and squeezes a trigger to designate that orientation as the starting position for an optical search scan.

Prior to the trigger event, station finder mode operates using the transforms shown on the upper line of FIG. 14. The NML (33*a*) is set to the ADL (32) by setting QNML to Identity (88). QORL (44) is a fixed misalignment of the MU Gyros (27) from the VAC Optical Reference Line (26), as discussed above in FIG. 10. The desired MU gyro nominal position (34*a*) is thus fixed at a slight offset from the ADL (32). The operation of soft cage mode and the integration of the offset transform, QCILOS (45), were discussed above in FIG. 10. QCILOS (45) captures the offset between the MU gyros, as they follow motion of the MU case (35), and their nominal position (34*a*).

When the station finder trigger event occurs, the current value of QCILOS (45) is logged as the search offset (QSearchOffset (89)). Once QsearchOffset (89) is logged, QNML (43) is computed using equation (91). Operation continues (bottom line in FIG. 14) by setting QCILOS to Identity (90) and using the computed value of QNML (43). This has the effect of starting the measurement search scan with the MU Gyros (35) in the orientation designated by the station finder trigger.

ADL Acquisition

Figure 15:
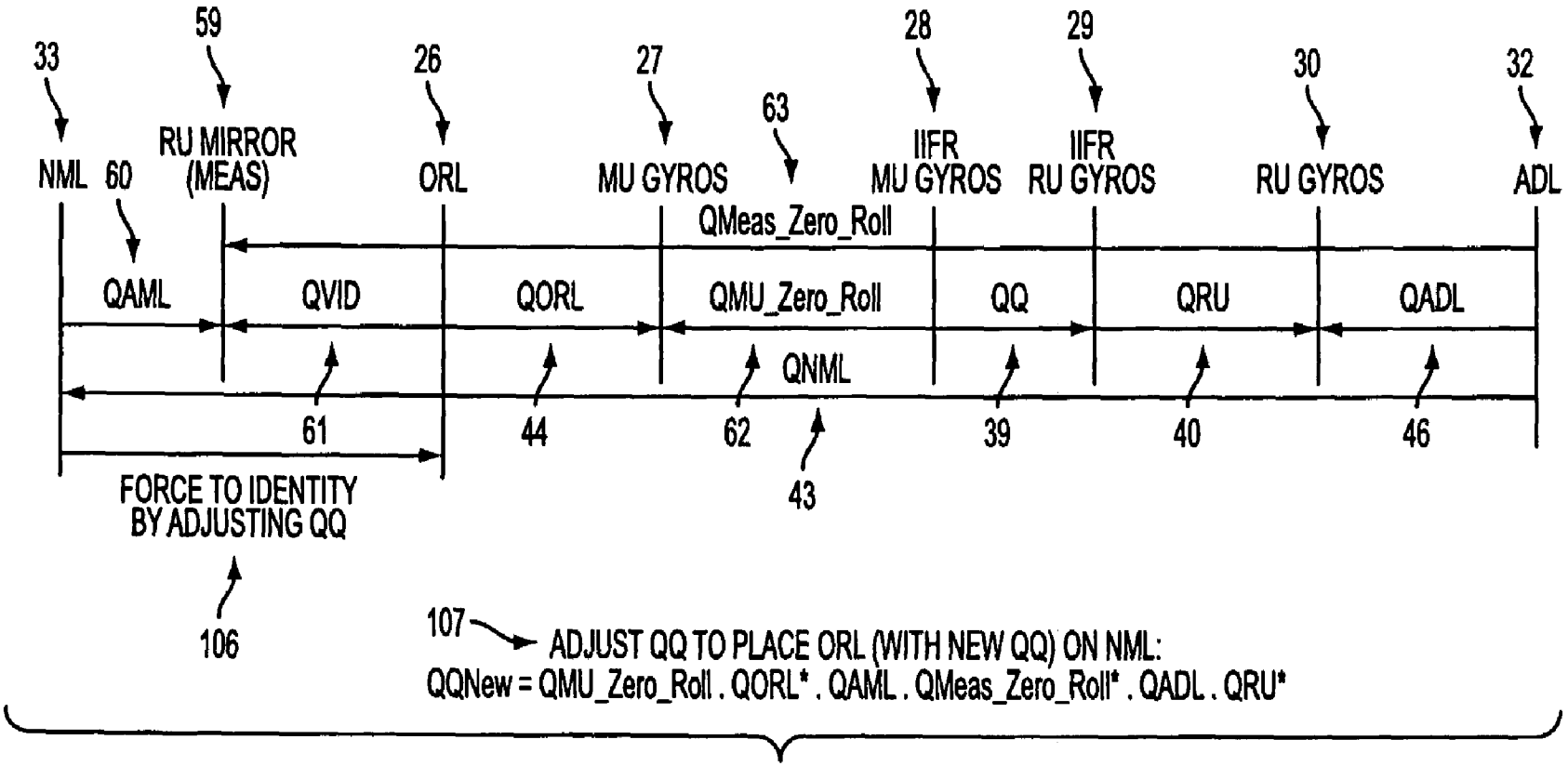
FIG. 15 illustrates transforms for performing armament data line acquisitions according to an exemplary embodiment of the present invention.

FIG. 15 shows the transform structure and processing used for ADL Acquisition. Many of these transforms have already been discussed above in FIGS. 10 and 13. The ADL acquisition process includes measuring ADL Reference Mirror 1 (115) and Mirror 2 (114) of RU 3, computing the misalignment between the MU and RU Gyros (27, 30), then applying a correction to realign the gyro frames and thereby zero out the effects of gyro drift. Corrections are applied by updating the QQ Quaternion (39). The QRU (40) and QMU (38) gyro integrations are not adjusted; any error that accumulates in these terms is compensated by reflecting it into a new QQ (39).

Two ADL Acquisition sequences are used. The normal (front) ADL acquisition measures the RU mirrors in a 1-2-1 sequence. An alternate side ADL Acquisition uses a 2-1-2 sequence.

The processing for both sequences is identical, and is summarized as follows:

a. QNML (43) is calculated for each RU mirror (114, 115) in ADL coordinates (32).

b. The first RU mirror (115) is measured and the measured mirror vector (VMeas in ADL Coordinates) (58) is recorded. The values of QRU (40) and QMU (38) must be logged at the time of each measurement.

c. The measurement vector (58) is converted to quaternion form [QMeas_Zero_Roll] (63), assuming zero roll.

d. The QAML quaternion (60) (Actual Mirror Line) is computed as shown below. Note: QAML is the measured mirror position with respect to the nominal mirror Position, and is equivalent to the accumulated drift error in the measurement vector (58). QAML=QNML*. QMeas_Zero_Roll e. The recorded QMU (38) is virtually de-rolled to form QMU_Zero_Roll (62) (See processing detail below).

f. A new value of QQ (39) (QQn+1) is computed (Equation 107) by setting a constraint that a mirror measurement computed using the recorded value of QRU (40), the computed value of QMU_Zero_Roll (62), and the new value of QQn+1 (39), will equal the NML (33). In other words, QQ (39) is adjusted to cause the ORL (26) to converge (106) on the NML (33) when the MU is virtually de-rolled (62).

g. Steps b through g are repeated for each mirror in the three-shot sequence.

h. An accuracy check is performed on the last measurement to verify the measured mirror position correlates with the expected position. If this test fails, the last two mirror measurements are repeated.

ADL Acquisition Processing Detail

NML Computation

The Nominal Mirror Lines (33) for the two RU mirrors are computed using the relations illustrated on the right side of FIG. 11, where EMirror_Survey_X (102) denotes the mirror survey data for RU Mirror 1 (115) & RU Mirror 2 (114), respectively:

QNML=QAdapter. Q[EMirror_Survey_X]

Virtual De-Roll of $QMU_{Aye}$:

{Y, P, R}=Eulerian[VMeas]

QMeas_Zero_Roll=Quat[{Y, P, 0}]

QMU_Zero_Roll=QQn.QRU.QADL*.QMeas_Zero_Roll.QORL

Computation of $QQ_{,n+1}$

The new value of $QQ_{n+1}$ is computed per Equation (107):

*QQn*+1=*QMU*_Zero_Roll.QORL*.QAML.QMeas_Zero_Roll*.QADL.QRU*

Accuracy Check

The accuracy check is used to determine if another iteration is required. It consists of verifying that both Eulerian angles {AMLYaw, AMLPitch}, for the last mirror in the sequence, are within tolerance. If it fails, the previous two mirror shots are to be repeated (2,1 for Normal ADL; 1,2 for Side ADL), and the accuracy check reapplied.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A gyroscopic system for translating parallel and non-parallel lines between a reference line and a device to be aligned with respect to the reference line, comprising:

a first inertial sensor configured to be substantially stationary, said first inertial sensor comprising a first three-axis gyroscopic sensor configured to produce an output signal and a reflector;

a second inertial sensor configured to be portable so as to be positionable adjacent to said first inertial sensor and comprising a gimbal restricted to two physical axes, a gimbal drive system, an electromagnetic energy beam generator, a second three-axis gyroscopic sensor configured to generate an output signal, and a collimator, said collimator being operable to determine an angle between a beam projected by said beam generator and a beam reflected from said reflector and to generate an output signal indicative of said determined angle; and a control circuit operable to process output signals generated by said collimator and said first and second three-axis gyroscopic sensors, to provide steering commands to the gimbal drive system to move the gimbal about its two physical axes such that the reflector and beam have a fixed orientation to perform calculations to compensate for a third physical axis, and determine relative orientations of said first and second inertial sensors with respect to each other.

2. The system of claim 1, further comprising a display unit receiving operator input and communicating with the control circuit.

3. The system of claim 1, further comprising an adapter coupled to the first inertial sensor for mounting the first inertial sensor to a vehicle and configured to hold the first inertial sensor at a predetermined angle offset from said reference line.

4. The system of claim 3, wherein the control circuit is operable to determine the relative orientations of said first and second inertial sensors with respect to each other taking into account the predetermined angle offset.

5. The system of claim 1, further comprising:

a second reflector mountable on advice at a predetermined angle offset from the reference line; and wherein said second inertial sensor is configured to generate an output signal indicative of said determined angle and to determine a second angle between a beam projected by said beam generator and a beam reflected from the second reflector to generate an output signal indicative of said second angle.

6. The system of claim 5, wherein said a control circuit is operable to use said gyroscope output signals and data relating to the position of said gimbal relative to said reference line to determine the orientation of said device with respect to said reference line.

7. A method for reference sighting, comprising:

a) determining a nominal mirror line in a base frame for each reference mirror;

b) measuring a first measurement vector for the first reference mirror;

c) logging an orientation of the first gyro and the second gyro at the time of the measuring;

d) converting the measurement vector to quaternion form;

e) computing an actual mirror line with respect to the nominal mirror line;

f) virtually de-rolling the orientation of the second gyro; and g) causing the optical reference line to converge on the nominal mirror line.

8. The method of claim 7, further comprising repeating b)–f) for each mirror.

9. The method of claim 7, further comprising verifying the measured position correlates with the expected position.

10. The method of claim 9, further comprising repeating the mirror measurement if the measured position does not correlate with the expected position.

11. A method for aligning a device comprising:

aligning a stationary inertial sensor with respect to a reference line;

projecting an electromagnetic beam from a portable inertial sensor to a mirror coupled to said stationary inertial sensor and detecting the angle of the reflected beam;

determining the relative position of said portable inertial sensor with respect to said stationary inertial sensor using the detected angle and output data from a first gyroscope provided in said stationary inertial sensor and a second gyroscope provided in said portable inertial sensor;

controlling a two-axis gimbaled platform carrying circuitry for generating the electromagnetic beam to orient the platform about two axes;

determining a compensation for movement of the platform about a third axis; and calculating a position of said device with respect to said reference line using said detected angle, said compensation and said output data.

12. The method of claim 11, further comprising:

mounting the stationary inertial sensor to the device at a predetermined angle offset from said reference line; and determining the relative orientations of said portable and stationary inertial sensors with respect to each other taking into account the predetermined angle offset.

13. The method of claim 11, further comprising:

receiving a trigger signal from an operator; and using an orientation of the portable inertial sensor as a starting position for an optical search.

* * * * *